United States Patent [19]

Zoonens

[11] Patent Number: 4,627,377

[45] Date of Patent: Dec. 9, 1986

[54] DAVIT DEVICE

[76] Inventor: Alain Zoonens, 147 bis rue de Silly, Boulogne, France

[21] Appl. No.: 702,086

[22] Filed: Feb. 15, 1985

[51] Int. Cl.[4] ..... B63B 23/02

[52] U.S. Cl. ..... 114/373; 114/366; 114/368; 114/369; 414/546

[58] Field of Search ..... 114/366, 365, 368, 369, 114/373, 230, 44; 187/9 R; 414/246, 486, 137–140, 708, 546; 187/9 R; 91/520

[56] References Cited

U.S. PATENT DOCUMENTS

| | | | |
|---|---|---|---|
| 3,671,986 | 6/1972 | Peters | 114/373 |
| 3,675,258 | 7/1972 | Osmundson | 114/368 |
| 4,271,553 | 6/1981 | Korsvik | 114/373 |
| 4,378,192 | 3/1983 | Gross | 414/708 |
| 4,467,894 | 9/1984 | Sinclair | 187/9 R |
| 4,512,708 | 4/1985 | Boichu | 414/708 |

*Primary Examiner*—Trygve M. Blix
*Assistant Examiner*—C. T. Bartz
*Attorney, Agent, or Firm*—Scrivener Clarke Scrivener and Johnson

[57] ABSTRACT

A platform for a small boat or the like is pivoted to the free end of a pair of arms which are pivoted at their opposite ends to a larger boat such as a yacht. The arms are controlled by an hydraulic jack and a second hydraulic jack is arranged to drive or be driven by the first jack to control the platform so that it is always horizontal for any position of the arms. The arms can position the platform below the water line for launching or receiving the small boat or well above the water line.

10 Claims, 4 Drawing Figures

DAVIT DEVICE

This invention relates to davit devices and more particularly to davit devices particularly, though not exclusively, adapted to use with yachts.

Davits of the projecting, "hanging" type are known, which are exclusively used for raising, lowering and launching lifeboats or auxiliary vessels. The major disadvantage of these conventional davits is that the lifeboats are suspended, which imposes significant constraints on their structure and may, in the long run, cause deterioration or require appropriate structural modifications to remedy such deterioration.

Another known method is to equip boats with swimming platforms, which are affixed to the stern of the boat and form an integral part thereof. This device may be adapted to provide for hanging the auxiliary vessel under the platform and said platform may be installed so that it pivots around a horizontal axis in such a way that it may be hoisted to a position parallel to the rear transom of the boat, for example, to a substantially vertical position. In this position, the auxiliary vessel is kept out of the water.

The major disadvantage of this type of conventional platform is keeping the auxiliary vessel in an overturned or sideways position when it is not in service, which requires that all unattached objects first be removed from the auxiliary vessel and that its motor be removed to avoid, for example, penetration of seawater into the cylinders through the exhaust ports. In addition, because the platform hangs relatively low over the water, the length of the auxiliary vessel, in the transverse, horizontal direction, relative to the boat, must be less then the horizontal width of the rear transom of said boat such that it does not laterally exceed the boat width in order to avoid exposure to swells.

The object of this invention is to provide a davit device which is designed to avoid the above cited disadvantages of conventional devices.

For this purpose, the invention provides a davit device which is characterized by the fact that the platform is adapted to carry on its surface an auxiliary vessel such as a lifeboat and is mounted on the boat, outside said boat, and may follow a translational movement while being maintained in a substantially horizontal position, from a position wherein it is elevated above the water to a position wherein it is advantageously lowered below the waterline to enable the auxiliary vessel to float.

According to one advantageous characteristic of the invention, the platform is supported by at least one articulated arm connected at one extremity to the platform, the arm being mounted so that it may pivot at its other extremity at the boat, servo-motor mechanisms being provided to maintain the horizontal position of the platform when said arm is pivoted.

According to another advantageous characteristic of the invention, the servo-motor mechanisms for positioning the platform are advantageously formed of a hydraulic jack installed between the platform and the means forming the pivot arm, and the mechanisms for controlling the pivoting of the arm are advantageously formed of other hydraulic mechanisms mounted between the arm and the boat, wherein the control mechanisms and the servo-motor mechanisms are adapted to interact so as to ensure tht the platform is maintained in the horizontal position.

A better understanding of the invention and a clarification of the other objects, details and advantages thereof shall be provided in the explanatory description which follows and which refers to the appended schematic drawings provided only as one example to illustrate one embodiment of the invention, wherein.

Figure 1:
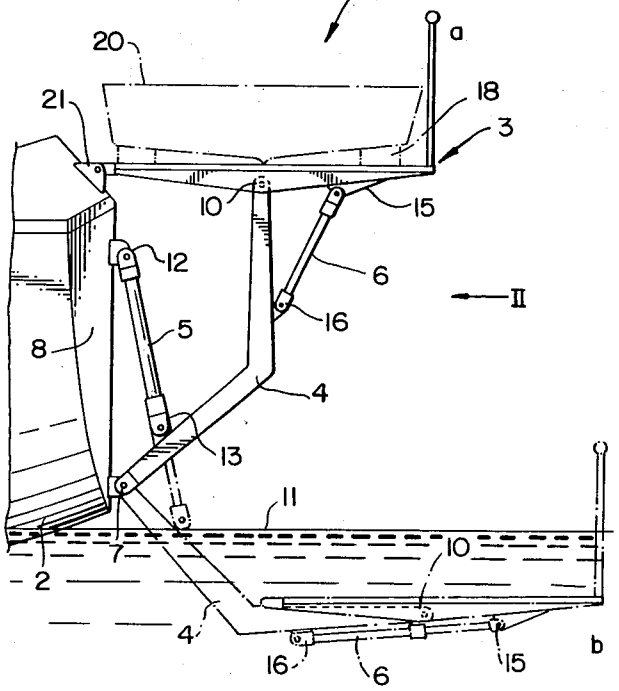
FIG. 1 is a lateral view of a davit device according to the invention, illustrating this device in its extreme positions.

According to the drawings, a davit device (1) is mounted on the stern section of a boat (2). The davit device (1) substantially comprises a platform (3) and two pivoting arms (4) to support the platform, lift mechanism (5) controls the pivotal movement of the arms (4) and leveling mechanism (6) is designed to maintain the platform (1) in a horizontal position, whatever may be the angular position of the supporting arms (4). Each of the arms (4) pivots in a vertical plane.

Figure 2:
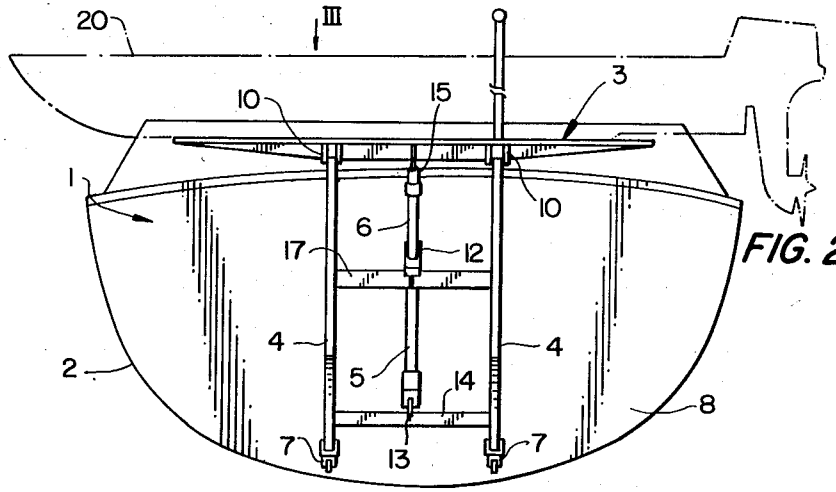
FIG. 2 is a view from the direction indicated by arrow II of FIG. 1 of the davit device according to the invention.
Figure 3:
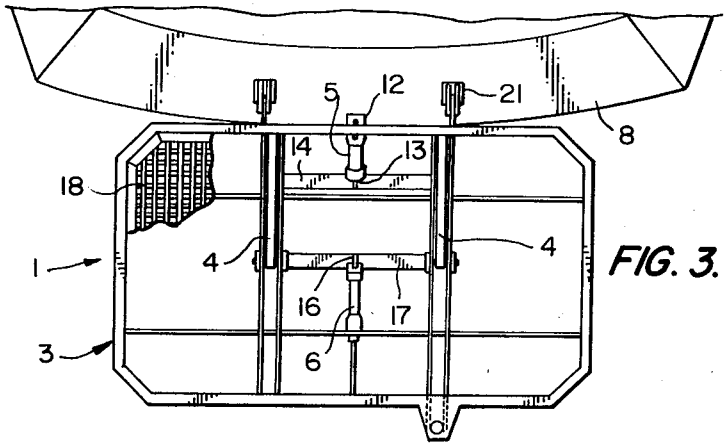
FIG. 3 is a view from the direction indicated by arrow III of FIG. 2, with a partial cut-away.

Each supporting arm (4) of the platform (1) is articulated at point 7, at the lower exterior part of the boat (2), above its waterline, preferably at the rear transom (8) thereof. The upper, free extremity of each arm (4) is articulated at point 10 at the lower structure of the platform (1). As illustrated in FIGS. 2 and 3, the points of articulation (10) of the arms (4) of the platform (1) are substantially located at the center of the platform, symmetrically with respect to the longitudinal axis of the boat.

As clearly illustrated in FIG. 1, the davit device according to the invention is adapted so that the platform (1) may follow a translational movement from one extreme position (a) wherein it is elevated above the water line (11) to another extreme position (b) wherein it is lowered below the waterline (11), while remaining in a horizontal position. To enable the platform to move between the two extreme positions (a and b), the supporting arms (4) are articulated in an appropriate manner in such a way that their top parts, articulated on the platform at point 10, extend vertically and horizontally depending on whether the platform is in its elevated position (a) or its lowermost position (b), respectively.

The lift mechanism (5) for controlling the pivoting of the arms (4) may be implemented in any appropriate manner; however, it is advantageously formed of a hydraulic jack which is articulated at one end, at point 12, on the rear transom (8) of the boat and, at its other end, at point 13, it is articulated on a transverse bar (14) which forms a crosspiece and extends between the two arms (4). The levelling means mechanism (6) maintaining the platform (1) in the horizontal position is formed of a servo-motor such as, for example, a hydraulic jack with its body articulated at point 15 on the lower structure of the platform and at point 16, by the extremeity of its piston rod, to a transverse bar (17) connecting the two arms (4). The hydraulic lift jack (5) for connecting the pivoting of the arms (4) and the levelling jack (6) for maintaining the platform (1) in the horizontal position are preferably automatically synchronized in accordance with the invention as explained hereinafter in order to ensure that the platform is constantly maintained in the horizontal position.

The shape and dimensions of the platform (1) are appropriate for accepting a cradle (18) which is adaptable to any type of auxiliary vessel such as a lifeboat (20), schematically illustrated by dotted lines in the figure.

The shape and dimensions of the pivoting arms (4) are such that, in the extreme, lowered position (b), the platform is immersed to a depth which is sufficient to provide for launching and floating of the lifeboat (20) and for placing a floating lifeboat (20) on the cradle (18). In the extreme, elevated position (a), the platform (1) is positioned at a level which is higher than the freeboard level of the boat. Two safety locking devices (21), on either side of the longitudinal axis of the boat (2), may be provided to make the platform a removable integral part of the structure adjacent to the boat, when it is in the extreme, elevated position (a). Each of the safety locking devices (21) may be formed, for example, of a bolt and strike which are integral parts of the boat and the platform, respectively, or vice versa, and which may be connected with a locking pin.

The platform may be equipped with remote controls for the jacks (5, 6), as hereinafter explained, and also with light indicators for showing the platforms status and/or its operation.

The invention particularly displays the major advantage of allowing for navigation of a boat in high seas with a maximum of safety for an auxiliary vessel located on its stern and, in addition, to enable the auxiliary vessel to be completely overturned on its cradle during storage in port or during an ocean crossing. The platform may also be used as a swimming and sunbathing platform or for other purposes, for example, as a hoist or elevator or similar uses.

Figure 4:
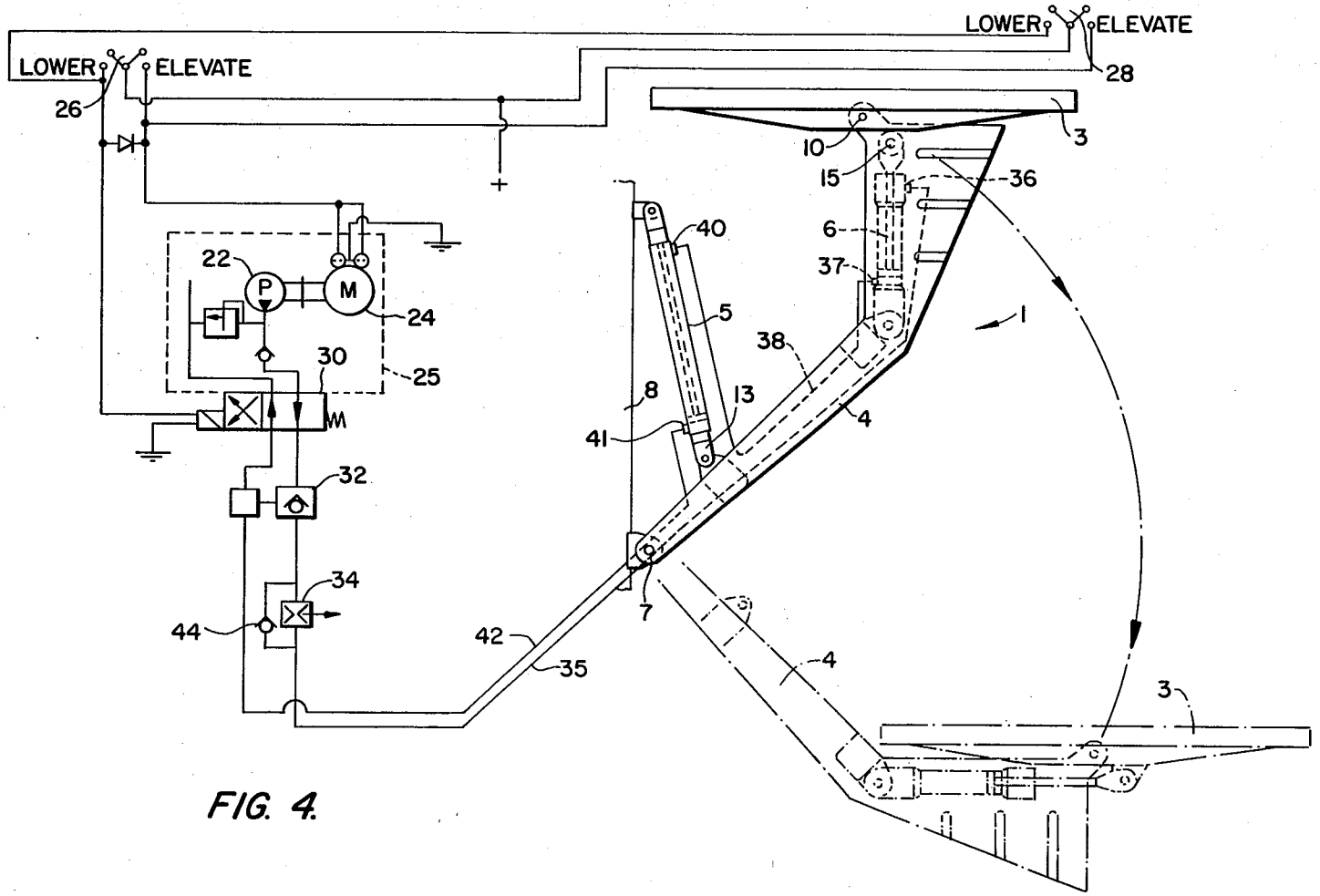
FIG. 4 is a schematic view showing the controls for the davit device.

With reference now to FIG. 4. The servo-jacks (5, 6) are operated by a pump (22) driven by an electric motor (24) controlled by either a selector switch 26 on the boat (2) or a selector switch (28) on the platform (3). The pump discharges fluid from a reservoir (25) through an electrovalve (30), which, in the position shown, connects the pump output through a pilot vlave (32) and limiting valve (34) in a conduit (35) to the end (36) of the levelling motor (6) proximate to the platform (3). The opposite end (37) of the motor (6) is connected by a flexible conduit (38) to the upper end (40) of the lift motor (5) whose opposite end (41) is connected by a conduit (42) through the electro-valve (30) to the reservoir (25).

Assuming the platform to be in its elevated position, when either the switch (26) or (28) is operated to the "lower" position, the pump motor (24) is energized and simultaneously the electro-valve (30) is shifted from the position of FIG. 4 to its second position wherein the pump output is delivered to conduit (42) and to the lower end of the servo motor (5) to extend the motor. As the motor extends, fluid above the motor piston is expelled into the conduit (38) and to the lower end of the leveling piston (6) to extend the servo-motor and expel fluid from above its piston through the connection (36), conduit (35) and shifted electro-valve (30) back to the reservoir. The limiting valve (34) controls the return rate of flow so that the platform is not lowered at excessive speed.

When the platform is to be raised, either switch (26) or (28) is operated to the "elevate" position. With the electro-valve (30) in its normal position of FIG. 3 the pump output is delivered to conduit (35), by-passing the limiting valve (34) through a one-way by-pass valve (44), and from there to the upper connection (36) of motor (6) to retract the same. As the motor (6) retracts fluid beneath the piston of motor (6) is expelled into conduit (38) and from there into the upper end connection (40) to retract motor (5) and effect elevation of the arms (58). When the platform is fully raised, the safety locking devices (21) may be engaged to ensure retention of the platform in its elevated position.

The volumes of the respective servo-motors (5 and 6) above and below there pistons are equal but clearly their strokes must be different in order to ensure that the platform is level regardless of its elevated position. It will be apparent that the levelling servo-motor connection (15) with the platform must be off-set from the pivot connection (10) of the arms with the platform. In FIG. 1, the pivot (15) is shown exageratedly to the right of the arm pivot (10), the degree of off-set being a function of motor volume and stroke.

It will be apparent that by the use of suitable check valves as well known in the art, the platform may be positioned anywhere between its fully raised and lower positions. Thus the platform can serve as an elevatable diving or sunning platform as well as a davit for boats.

It is understood that numerous modifications may be made to the embodiment which has just been described and which is illustrated in the drawings, while remaining within the scope of this invention. The platform may be located at any other point on a boat. The supporting arms may be articulated on the platform, at its lateral sides and/or at the side which is adjacent to the boat. A single supporting arm may be sufficient to support the platform.

I claim:

1. A lifting and lowering device for use with a vehicle comprising a platform mounted on the vehicle and extending outside said vehicle, pivoting arm means having a free end articulated to the platform and its other end pivoted to the vehicle, a first hydraulic jack mounted between the platform and said arm means and a second hydraulic jack mounted between said arm means and said vehicle, means for connecting one or the other of respective opposite ends of said first and second jacks to a source of fluid pressure while simultaneously connecting to drain that one of said opposite ends which is not connected to said source, and means fluidly connecting together the other respective opposite ends of said jacks such that when either one of said jacks is operated in response to fluid pressure it transmits fluid pressure to the other jack to operate it simultaneously with said one jack.

2. The device as claimed in claim 1, wherein the volume capacity of those ends of the respective jacks which are fluidly connected (37, 40) together and the strokes of said jacks (5, 6) are preselected that for any degree of movement imparted to one jack by said fluid pressure from said source (22) a proportionate degree of movement is imparted by said one jack to the other jack, said proportionate degrees of movement being selected so that for any position of said arm means (41) said platform (3) is positioned to be horizontal with respect to said arm means (41).

3. A device as claimed in claim 1 wherein said vehicle is a boat and said other end of said arm means(4) has a pivotal mounting at the lower exterior part of said boat.

4. A device as claimed in claim 3, wherein the free end of said arm means (4) is articulated on the lower side of the platform at the center part thereof.

5. A device as claimed in claim 3 wherein said pivotal mounting for said arm means is positioned above the waterline of said boat, said arm means being constructed and arranged to enable the platform to be lowered below the waterline (11).

6. A device as claimed in claim 3 wherein the platform (3) is provided at the stern of the boat, said arm means (4) is articulated on the rear transom (8) of said boat.

7. A device as claimed in claim 3 wherein said arm means (4) comprises two pivoting arms.

8. A device as claimed in claim 7, wherein said two pivoting arms (4) are connected by a crosspiece (14) and by the fact that said second jack (5) is articulated at its extremities on the boat (2) and on the center part of the crosspiece (14), respectively.

9. The device as claimed in claim 1, including a system for selectively delivering fluid pressure from said source to one or the other end (36, 41) of said jacks (5, 6) said system comprising a fluid reservoir (25), a pump (22) having an inlet connected to said reservoir (25) and an outlet connected to a two position electro-valve (30), said electro-valve (30) having one position connecting the outlet of said pump means (22) to one of the respective opposite ends (36, 41) of said jacks (5, 6) while connecting the other end to drain into said reservoir 25, and in a second position reversing said connections, switch means (28) movable between off, lower and elevate positions, said switch means (26) when moved from off to either lower or elevate positions effecting energization of said pump means (22) while simultaneously positioning said electro-valve (30) that fluid pressure is delivered to one or the other of said jacks (5, 6) to effect lowering or raising of said arm means (4) and said platform (3) in accordance with the selected lower or elevate position of said switch means (26).

10. The device as claimed in claim 9, wherein said vehicle is a boat and said switch means (26) is located on said boat (2) and a second switch means (28) is located on said platform (3), said second switch means (28) being substantially the same as said first switch means (26) and being connected in parallel therewith whereby said arm means (4) and said platform (3) may be controlled from either said boat (2) or said platform (3).

* * * * *